US008209935B2

(12) United States Patent
Heady et al.

(10) Patent No.: US 8,209,935 B2
(45) Date of Patent: Jul. 3, 2012

(54) METHOD AND APPARATUS TO FIX WOODEN AND OTHER FOUNDATIONS

(76) Inventors: Timothy P. Heady, Elkhart, IA (US); Charles W. Heady, Perry, IA (US)

( * ) Notice: Subject to any disclaimer, the term of this patent is extended or adjusted under 35 U.S.C. 154(b) by 0 days.

(21) Appl. No.: 12/861,962

(22) Filed: Aug. 24, 2010

(65) Prior Publication Data

US 2010/0313520 A1 Dec. 16, 2010

Related U.S. Application Data

(63) Continuation of application No. 11/009,499, filed on Dec. 10, 2004, now Pat. No. 7,861,469.

(51) Int. Cl.
*E04B 1/00* (2006.01)

(52) U.S. Cl. ..... 52/745.09; 52/127.2; 52/126.3; 52/150

(58) Field of Classification Search ..... 52/127, 52/127.2, 514, 506.05, 741.1, 745.9, 742, 52/169.6, 293, 743, 744, 162, 741.13, 745.09; 248/544; 405/262, 284, 259; 254/100
See application file for complete search history.

(56) References Cited

U.S. PATENT DOCUMENTS

| | | | | | |
|---|---|---|---|---|---|
| 587,274 | A | * | 7/1897 | Rue | 254/101 |
| 1,031,049 | A | * | 7/1912 | Conzelman | 269/114 |
| 2,684,824 | A | * | 7/1954 | Hillberg | 248/354.5 |
| 2,914,147 | A | | 11/1959 | Millard | |
| 3,030,061 | A | | 4/1962 | Jennings | |
| 3,095,666 | A | * | 7/1963 | Killen | 248/449 |
| 3,537,220 | A | * | 11/1970 | Ellis | 52/223.5 |
| 3,817,006 | A | | 6/1974 | Williams | |
| 3,874,625 | A | * | 4/1975 | Hansen et al. | 248/354.5 |
| 4,021,905 | A | * | 5/1977 | Benton et al. | 29/402.09 |
| 4,068,427 | A | * | 1/1978 | Camardo | 52/127.2 |
| 4,083,156 | A | * | 4/1978 | Tye | 248/354.5 |
| 4,189,891 | A | * | 2/1980 | Johnson et al. | 52/741.13 |
| 4,268,066 | A | | 5/1981 | Davis | |
| 4,288,899 | A | * | 9/1981 | McKee | 29/256 |
| 4,304,078 | A | | 12/1981 | Meriwether, Jr. | |
| 4,353,194 | A | * | 10/1982 | Norton | 52/741.13 |
| 4,365,451 | A | * | 12/1982 | Nelson | 52/169.9 |
| 4,452,019 | A | * | 6/1984 | Ikuo et al. | 52/167.1 |
| 4,465,648 | A | * | 8/1984 | Kiriyama et al. | 264/30 |
| 4,669,704 | A | * | 6/1987 | Abraham et al. | 254/100 |
| 4,752,214 | A | * | 6/1988 | Justus | 432/3 |
| 4,763,878 | A | * | 8/1988 | Abraham et al. | 254/100 |
| 4,872,634 | A | | 10/1989 | Gillaspy et al. | |
| 4,893,784 | A | * | 1/1990 | Abraham et al. | 254/100 |
| 4,895,335 | A | * | 1/1990 | Oliver | 248/354.3 |

(Continued)

*Primary Examiner* — Brian Glessner
*Assistant Examiner* — Joshua Ihezie
(74) *Attorney, Agent, or Firm* — McKee, Voorhees & Sease, P.L.C.

(57) ABSTRACT

A method and apparatus for supporting and straightening a framed wall includes a plurality of beams, a mounting plate, a bolt, and a pusher. The mounting plate is secured to the beam and the bolt is threadably secured to the mounting plate. The bolt is received by the pusher. When tightened, the bolt applies pressure to the pusher which in turn applies pressure to the framed wall. Alternatively, a plurality of mounting plates and pushers may be used to apply pressure to a cross beam and thereby efficiently apply pressure to a plurality of framed wall beams. By tightening the bolt, the user can apply pressure to the beam and straighten or retain the wall. As the wall shifts during periods of correction, the bolt may be re-tightened to apply additional pressure to the wall.

3 Claims, 4 Drawing Sheets

U.S. PATENT DOCUMENTS 4,930,285 A * 6/1990 Ward ..... 52/742.12
4,937,989 A 7/1990 Miyares et al.
4,970,835 A * 11/1990 Harmon ..... 521/62
5,048,796 A * 9/1991 Maldonado ..... 254/100
5,401,120 A * 3/1995 Hussey et al. ..... 405/132
5,496,081 A * 3/1996 Rice ..... 292/259 R
5,620,038 A * 4/1997 DeCola et al. ..... 160/209
5,845,450 A * 12/1998 Larsen ..... 52/574
5,857,300 A * 1/1999 Gates ..... 52/426
5,875,606 A * 3/1999 Jensen ..... 52/741.41
5,913,787 A 6/1999 Edwards
5,943,830 A * 8/1999 Truitt ..... 52/127.2
5,956,906 A 9/1999 Berich et al.
5,983,587 A * 11/1999 Limonad ..... 52/514
6,023,901 A * 2/2000 Jensen ..... 52/514
6,073,405 A 6/2000 Kasai et al.
6,112,475 A * 9/2000 Truitt ..... 52/127.2
6,141,932 A * 11/2000 Tarrant ..... 52/514
6,145,260 A * 11/2000 Morton ..... 52/293.2
6,354,050 B1 * 3/2002 Pankoski ..... 52/293.3
6,357,190 B1 * 3/2002 Florentine ..... 52/293.2
6,450,480 B2 * 9/2002 Massile ..... 254/93 R
6,539,677 B1 * 4/2003 Lanka ..... 52/127.2
6,662,505 B2 * 12/2003 Heady et al. ..... 52/127.2
6,769,222 B2 * 8/2004 Billante ..... 52/741.15
7,121,054 B2 10/2006 Shock
7,380,372 B2 * 6/2008 Resch et al. ..... 52/127.2
2003/0131555 A1 * 7/2003 Heady et al. ..... 52/741.15
2003/0192280 A1 * 10/2003 Billante ..... 52/514
2005/0086889 A1 * 4/2005 Shock ..... 52/514
2005/0204673 A1 * 9/2005 Reed ..... 52/514

* cited by examiner

METHOD AND APPARATUS TO FIX WOODEN AND OTHER FOUNDATIONS

CROSS-REFERENCE TO RELATED APPLICATIONS

This application is a Continuation Application of U.S. Ser. No. 11/009,499 filed Dec. 10, 2004, herein incorporated by reference in its entirety.

BACKGROUND OF THE INVENTION

1. Field of the Invention

The present invention relates generally to an apparatus and method of repairing walls which have been damaged including cracking and bowing from hydrostatic pressure, freezing or other reasons. More particularly, the present invention relates to an apparatus and method for supporting and straightening damaged framed walls 2. Problems in the Art Basement walls tend to crack or bow for a variety of reasons. Most prior art systems tend to pull the wall back into position by providing an anchor in the soil surrounding the wall. A hole is drilled in the wall and a wire is secured to both the anchor and the wall. By pulling on the wire, the wall is supposed to be pulled back into position. However, given the varying types of soils outside of the wall, such systems are prone to failure. It is therefore desirable to provide a straightening apparatus and method which does not rely on the use of soil outside of the wall. Conventional indoor supporting and straightening devices occupy a large amount of interior space. As this has a direct impact on the utility of the basement, it is desirable to have a supporting apparatus which minimizes the intrusive effect of prior art devices.

Other prior art systems allow pressure to be applied by a user but require additional hardware to keep the device in a set position. It is therefore desirable to provide a straightening device which allows for the application and maintenance of pressure without additional hardware.

However, and importantly, many walls are framed in wood or other non-concrete materials. If these framing materials become warped or dislocated for any reason, an external anchoring system will not be available to address the problem. Instead, framing materials are typically replaced at a substantial cost. Replacement also causes extensive modifications be made to the existing structure to ensure there is not a further loss of structural stability. U.S. Pat. No. 6,662,505 which issued to Heady on Dec. 16, 2003, solved many of these problems.

There remains a need for an apparatus and method for straightening and supporting damaged framed walls which avoids the problems of the prior art.

FEATURES OF THE INVENTION

A general feature of the present invention is the provision of an improved method and apparatus for supporting and straightening a damaged wall which overcomes the problems found in the prior art.

A further feature of the present invention is the provision of a method and apparatus for supporting and straightening a damaged wall which does not rely upon an anchor in soil.

Another feature of the present invention is the provision of a method and apparatus for supporting and straightening a damaged wall which takes up a minimum amount of space in the room in which the wall is located.

A still further feature of the present invention is the provision of a method and apparatus for supporting and straightening a damaged wall which can vary the amount of pressure applied to the wall.

Another feature of the present invention is the provision of a method and apparatus for supporting and straightening a damaged wall in which pressure applied to the wall may be increased to continually straighten the wall over a period of time.

A further feature of the present invention is the provision of a method and apparatus for supporting and straightening a damaged wall in which pressure may be applied to a wall across a plurality of wall joints.

Another feature of the present invention is the provision of a method and apparatus for supporting and straightening a damaged wall in which wall framing can be straightened without removal.

A still further feature of the present invention is the provision of a method and apparatus for supporting and straightening a damaged wall in which support can be provided in a horizontal and a vertical direction.

This, as well as other features and advantages of the present invention, will become apparent from the following specification and claims.

SUMMARY OF THE INVENTION

The present invention generally comprises a first and second bracket with one of the brackets secured into the basement floor. The other bracket is secured into the joist of the floor above the basement. A beam is then place between the brackets and the damaged wall. One of the brackets is placed into a position such that when the beam is installed, the beam will contact the wall. The other bracket is placed further away from the wall. When the beam is installed, there will be a gap between the beam and this bracket. In between this bracket and the beam, a jack is installed. A second beam is similarly located with a second set of brackets a desired distance apart from the first beam. In between the two beams, a cross-member or cross beam is placed to provide additional pressure to the wall. The cross-member can also be secured in place with a plate. The plate or pusher will provide a means for applying additional pressure to the wall via the cross-member. The cross-member allows the present invention to apply pressure to a wall in both a vertical and horizontal directions and allows the present invention to straighten a wall regardless of whether the wall is made of concrete or framing materials.

In a preferred embodiment, the jack of the present invention includes a holding bracket, a nut, and a bolt. The holding bracket is placed against the beam and the bolt is inserted through the secured bracket. Before the bolt contacts the holding bracket, a nut is installed on the bolt between the secured bracket and the holding bracket. Alternatively, the nut can be welded or otherwise permanently secured to the secured bracket or incorporated as threads within the secured bracket itself. By tightening the nut and bolt combination, the bolt may be extended to contact and apply pressure to the holding bracket. In turn, the holding bracket applies pressure to the beam which applies pressure to the wall.

A cross member or cross beam is placed between two beams which may or may not employ the jack discussed above. A mounting plate is secured to the beam. The mounting plate preferably includes a threaded hole through which a bolt may be secured. The bolt is threaded through the hole and the end is secured to or contained in a pusher. The pusher generally includes a plate adapted to receive the bolt. The plate contacts the cross beam or alternatively contacts a specified area on the framed wall. When the bolt is tightened, it applies pressure to the plate and in turn to the cross beam. The cross beam in turn applies this pressure to the beams of a framed wall. This allows the present invention to reliably apply the desired amount of pressure to straighten or support a damaged framed wall, while minimizing the amount of space used in the basement.

DETAILED DESCRIPTION OF THE PREFERRED EMBODIMENT(S)

The present invention will be described as it applies to its preferred embodiment. It is not intended that the present invention be limited to the described embodiment. It is intended that the invention cover all modifications and alternatives which may be included within the spirit and scope of the invention.

Figure 1:
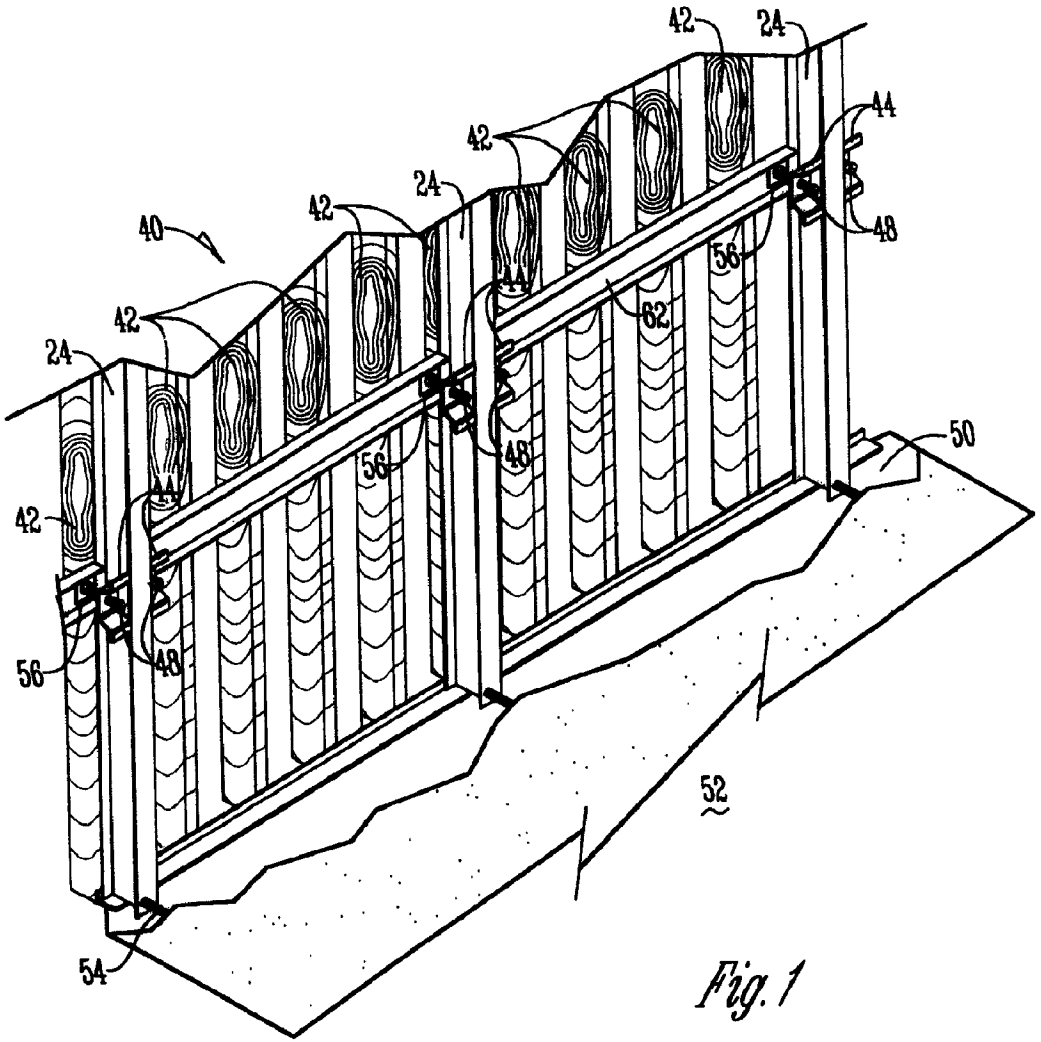
FIG. 1 is a perspective view of one embodiment of the present invention.

Now, referring to the drawings, FIG. 1 illustrates the system 40 for supporting and straightening a damaged framed wall including a plurality of beams 42. Occasionally, a basement wall will crack and bulge as a result of freezing or hydrostatic pressure. To prevent this from occurring, and to correct any bulges or cracks which may have already occurred, the system 40 of the present invention is installed.

Figure 2:
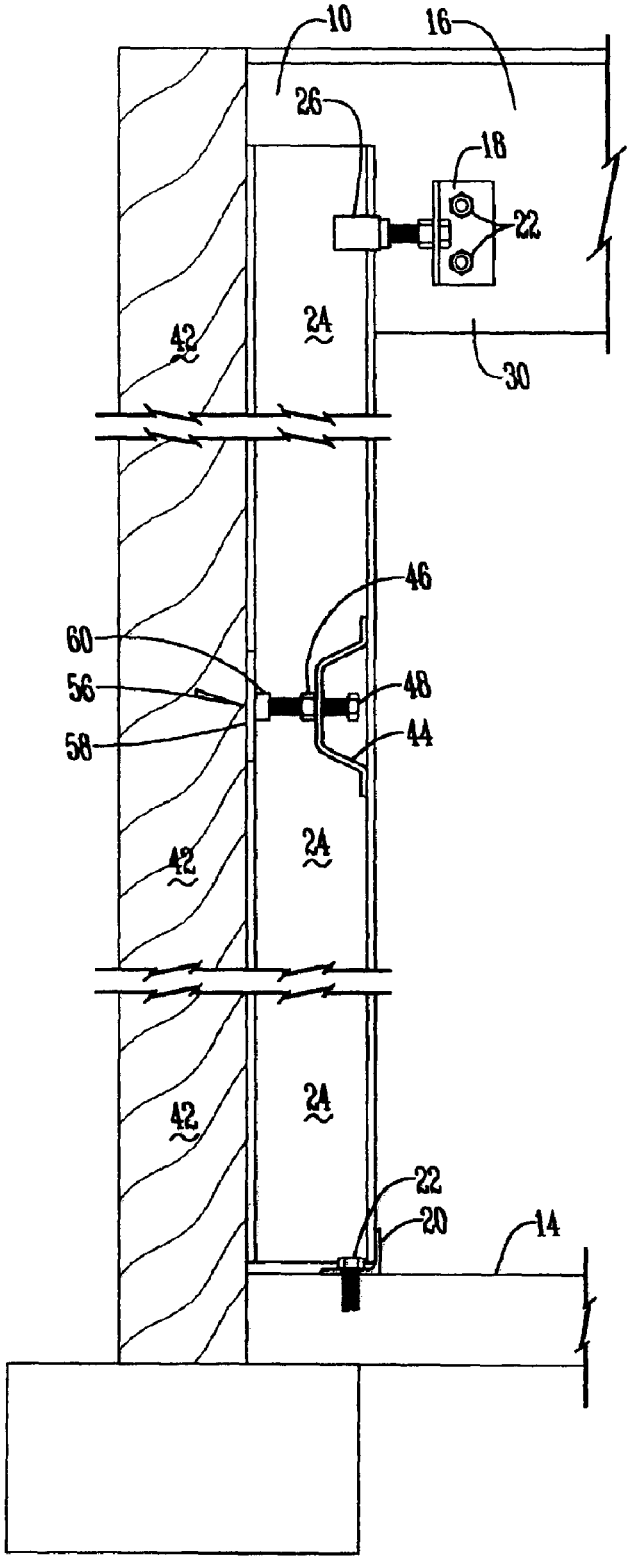
FIG. 2 is a cross-sectional view of the present invention.

The system 40 of the present invention preferably includes several beams 24. Preferably, the beams 24 are secured to the basement floor 14 and ceiling joists 16 as described in U.S. Pat. No. 6,662,505. As shown in FIG. 2, a first secured bracket 18 is preferably connected to a floor joist 16 which helps to form the floor support for the floor above the basement. The first secured bracket 18 is preferably a five inch long piece of three and a half inch angle iron with two 2 13/16" holes in one leg and one 1/16" hole in the other leg. Two bolts 22 fit through the two holes and secure the first bracket 18 to the floor joist 16. A second secured bracket 20 is a five and a half inch piece of two inch angle iron with 13/16 inch holes in one leg to accommodate two ¾ inch concrete anchors. Using the two concrete anchors 22, the second secured bracket 20 is mounted onto the concrete floor 14 of the basement. A beam 24, such as a four inch 7.7 per pound foot I-beam, is then placed between the first and second brackets 18, 20 and the wall 12. As can be seen in FIG. 2, a generally C-shaped holding bracket 26 is placed on the beam 24 between the beam 24 and the first secured bracket 18.

A jack 30 is then placed to operate between the first bracket 18 and the beam 24. The jack 30 is substantially or completely horizontal in order to minimize the amount of interior space needed by the jack 30. Preferably the jack 30 includes a one-inch thick bolt 32 of any desired length that is placed in the corresponding hole on the first bracket 18 to contact the holding bracket 26. The contact position of the bolt 32 on the holding bracket 26 may be insured by welding a half-inch piece of a 1 ¼" diameter pipe, or retaining ring 28, in the center of the holding bracket 26. The holding bracket 26 is preferably a 1.5 inch piece of four inch by 1 ½" inch channel. Of course other materials and means of securement may be used and are considered to be within the scope and teaching of the present invention.

As can be seen in FIG. 2, the holding bracket 26 keeps the beam 24 from shifting as pressure is applied. Pressure is applied by extending the jack. In the preferred embodiment, the jack is extended by turning the bolt 32 while holding the nut 34 in position. Alternatively of course, turning the nut 34 while holding the bolt 32 would also work. Turning the bolt 32 in a tightening fashion applies pressure to the holding bracket 26 which in turn applies pressure to the beam 24 which applies pressure to the wall 12. In this way, the wall 12 may be reinforced or gradually pushed back into position.

As the wall 12 moves back into a more straightened position, it may be necessary to apply additional pressure with the jack 30. Preferably, this may be done by simply tightening the bolt 32. In this way, the bracketing system of the present invention can be properly adjusted to work over time to straighten the wall.

Alternatively, the beams 24 may be secured directly to the concrete through any number of securing devices 54, such as concrete screws. In another embodiment, a trench 50 may be dug in the concrete floor 52 and the beams 24 may be secured in place by a jack or screw 54.

A mounting plate 44 is welded or otherwise secured to the side of the beam 24 before or after the beams have been installed. Preferably, at least two beams 24 are used. The mounting plate 44, generally a C-shaped piece of iron, is secured on the side of one of the beams 24 at a height the user desires. The position of the mounting plate 44 will generally be the position of the cross member or cross beam 62 or the location on the wall framing 42 where pressure is desired.

The mounting plate 44 includes a hole sized to accommodate a bolt 48. As is shown in FIG. 2, a nut 46 is welded to the mounting plate 44 such that the hole in the nut 46 corresponds to the hole in the mounting plate 44. Alternatively, the hole in the mounting plate 44 may be threaded. The bolt 48 is placed through the hole in the mounting plate 44 and threaded through the nut 46.

Figure 3:
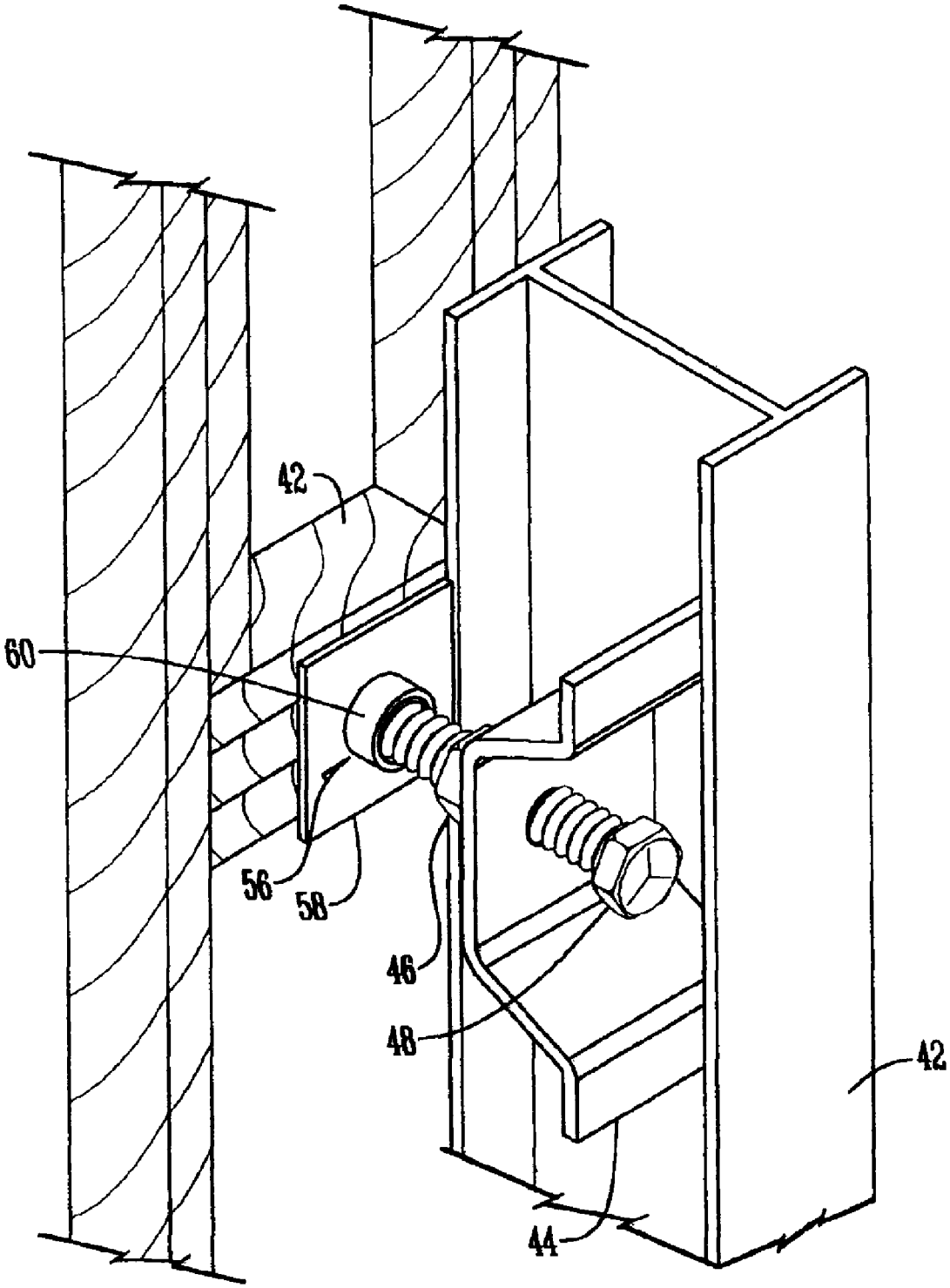
FIG. 3 is a perspective view of one embodiment of the present invention applied to a section of wall framing material.

Once in place, the bolt 48 is tightened until it contacts the pusher 56. The pusher 56 generally includes a plate 58 adapted to receive the bolt 48. As shown in FIG. 3, the plate 58 includes a ring 60 welded to create a cylindrical hole to accommodate the bolt 48.

Figure 4:
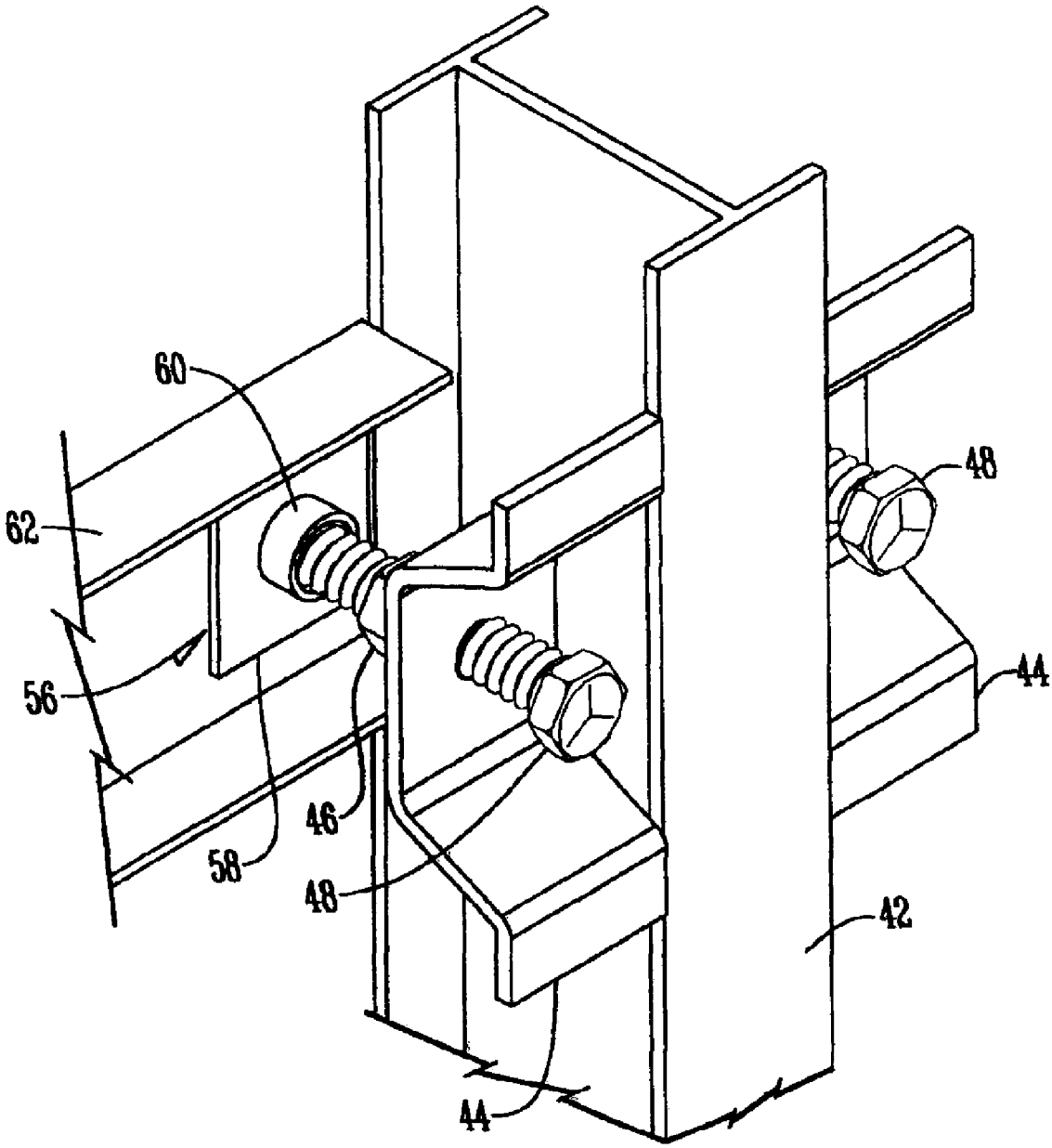
FIG. 4 is a close up perspective view of another embodiment of the present invention.

The pusher 56 may directly contact the beam 42 of the framed wall if the user desires. Alternatively and as shown in FIG. 4, the user may add a cross beam 62 to apply pressure across a plurality of framed wall beams 42. This arrangement is generally shown in FIG. 1. The cross beams 42 are preferably C-shaped or I-shaped such that they include an upper edge that prevents the cross beams 42 from falling during initial application of pressure from the pusher 56. Once pressure is applied, it can be easily seen how the present invention will help to straighten framed walls.

A general description of the present invention as well as the preferred embodiment of the present invention has been set forth above. Those skilled in the art to which the present invention pertains will be able to practice additional variations in the methods and systems described which fall within the teachings of this invention. Accordingly, all such modifications and additions are deemed to be within the scope of the invention which is to be limited only by the claims appended hereto

What is claimed is:

1. A method of straightening a deformed framed wall that includes a plurality of framed wall beams in a room having an interior space defined at least in part by a floor, at least one ceiling joist, and the deformed framed wall, the method comprising:

securing a first beam in a desired position along the framed wall;

applying pressure to the framed wall by tightening a first bolt through a first mounting plate secured to the side of the first beam, wherein the first bolt presses against a pusher that is in contact with one of the framed wall beams to thereby press the pusher against the one of the framed wall beams;

securing a first ceiling bracket to a ceiling joist;

securing a first floor bracket to the floor;

wherein the step of securing the first beam in the desired position comprises securing the first beam between the first ceiling bracket and the first floor bracket in a generally vertical alignment, and wherein a jack is secured to one of the brackets to apply additional pressure to the first beam;

securing a second ceiling bracket to the ceiling joist;

securing a second floor bracket to the floor;

securing a second beam between the second ceiling bracket and the second floor bracket, wherein a second mounting plate is secured to the second beam;

positioning a cross beam between the first and second mounting plates in a generally horizontal alignment; and applying additional pressure to the framed wall by tightening a second bolt through the second mounting plate which acts against a second pusher to thereby press against the cross beam and apply pressure across more than one of the wall beams.

2. The method of straightening a deformed framed wall of claim 1 wherein the pusher contacts a cross beam to apply pressure across a plurality of framed wall beams.

3. The method of claim 1, wherein the jack is secured to the first ceiling bracket.

* * * * *